United States Patent [19]

Pyykkönen

[11] 4,265,705

[45] May 5, 1981

[54] APPARATUS FOR CLEANING DOCTOR BLADES IN PAPER MACHINES

[75] Inventor: Markku Pyykkönen, Jyväskylä, Finland

[73] Assignee: Valmet Oy, Finland

[21] Appl. No.: 47,868

[22] Filed: Jun. 12, 1979

[30] Foreign Application Priority Data

Jun. 16, 1978 [FI] Finland ..... 781935

[51] Int. Cl.[3] ..... D21F 3/00

[52] U.S. Cl. ..... 162/272; 15/256.51; 15/256.53; 100/174

[58] Field of Search ..... 162/272; 15/256.51, 15/256.53, 256.52; 100/174; 101/425; 355/15

[56] References Cited

U.S. PATENT DOCUMENTS

| | | | |
|---|---|---|---|
| 1,889,836 | 12/1932 | Norman | 162/272 |
| 3,292,201 | 12/1966 | Bodard | 15/256.51 |
| 3,481,727 | 12/1969 | Dickinson et al. | 15/256.52 |
| 3,879,124 | 4/1975 | Eppe et al. | 15/256.52 |
| 4,133,073 | 1/1979 | Marzoli | 15/256.51 |

FOREIGN PATENT DOCUMENTS

| | | | |
|---|---|---|---|
| 612984 | 6/1978 | U.S.S.R. | 162/272 |

*Primary Examiner*—S. Leon Bashore
*Assistant Examiner*—Steve Alvo
*Attorney, Agent, or Firm*—Steinberg & Raskin

[57] ABSTRACT

In a paper making machine, apparatus for cleaning a doctor blade which extends across a roll of the paper making machine in the cross-machine direction includes a frame mounted for oscillating movement over the length of the doctor blade, which frame is driven by drive apparatus preferably in the form of an air cylinder whose piston is coupled to the frame to oscillate the same and a blade cleaning brush carried by the frame in a manner such that the brush engages the doctor blade to clean the same as the frame is oscillated by the drive apparatus. The brush preferably comprises a rotatable, disc-shaped brush equipped with an air motor for rotating the same. The present invention provides the capability of cleaning the doctor blades of paper machines without necessitating interruption of the machine operation.

7 Claims, 2 Drawing Figures

APPARATUS FOR CLEANING DOCTOR BLADES IN PAPER MACHINES

BACKGROUND OF THE INVENTION

This invention relates generally to apparatus for cleaning the doctor blades of a paper machine and, more particularly, to doctor blade cleaning apparatus which can operate in an automatic manner without interruption of the operation of the paper machine.

Paper making machines use a variety of different rolls for various functions during the paper making process. Thus, for example, press rolls, drying cylinders, and calender rolls are well known components of paper making machines. During the paper making process, various impurities adhere to the surface of the rolls which must be periodically cleaned. Doctor blades are conventionally utilized for cleaning these rolls.

A conventional doctor blade generally comprises the blade per se which extends in the cross-machine direction parallel to the axis of the roll being cleaned by it, the blade engaging the surface of the roll as the latter rotates. The blade is carried by a doctor blade beam which is usually attached to the frame of the paper making machine at bearing housings which are either specially provided or which constitute the bearing housings of the rolls. The pressure exerted by the doctor blade on the roll surface is usually selectively adjustable, such as by means of compressed air cylinders and, additionally, the doctor blades can generally oscillate.

As mentioned above, impurities such as paper fluff adhere to the paper machine rolls and are removed therefrom by the cleaning action of the doctor blades. Of course, the paper fluff and other impurities tend to stick to the doctor blades and, consequently, it is necessary to periodically clean the doctor blades. It is not uncommon for the doctor blades to be cleaned in a typical paper making machine at intervals of every one half to one hour. However, in order to clean conventional doctor blades, it is necessary to interrupt the operation of the paper making machine. More particularly, doctor blades are presently manually cleaned by means of brushes, scrapers and/or water jets. Since such manual operations require an extreme proximity of the cleaning personnel with the doctor blade and associated roller thereby rendering the work relatively dangerous, it is not possible to clean the doctor blades using presently known methods during operation of the paper making machine. Further, such manual cleaning procedures during machine operation would endanger the integrity of the web which, if obstructed, would most likely break if the paper making machine were operating.

Cleaning of the doctor blades is of particular importance in areas where it is possible to drive the broke downwardly through a defined space by means of gravity such, for example, at a smooth-surfaced stone roll, at the last cylinder of the drying section of the machine, and at the drying cylinders which precede the sizing press.

The use of conventional methods and apparatus for cleaning doctor blades necessarily requires cleaning intervals having a relatively long duration during which time the paper machine operation is interrupted. Such extended periods of interruption often result in difficulties arising in the operation of the paper making machine and, additionally, the quality of the paper produced correspondingly diminishes.

SUMMARY OF THE INVENTION

Accordingly, one object of the present invention is to provide new and improved apparatus for cleaning doctor blades associated with rolls in paper making machines.

Another object of the present invention is to provide new and improved doctor blade cleaning apparatus having the capability of cleaning the doctor blades without requiring interruption of the operation of the paper making machine.

Still another object of the present invention is to provide new and improved doctor blade cleaning apparatus which can automatically clean doctor blades at desired intervals without the danger of diminishing the quality of the paper being produced, without causing difficulties in the operation of the paper making machine and without the possibility of web rupture during cleaning.

Briefly, in accordance with the present invention, these and other objects are attained by providing a frame movably mounted in the area of the doctor blade which is coupled to drive apparatus for moving the frame in an oscillatory manner over substantially the entire length of the doctor blade in the cross-machine direction. The frame carries a cleaning device, preferably a disc-shaped rotatable brush which engages the doctor blade during the oscillating movement of the frame to clean the doctor blade. The apparatus for driving the frame and cleaning device mounted thereon in its oscillating movement preferably, although not necessarily, comprises a compressed air cylinder having a piston disposed therewithin to which the frame is coupled for oscillatory movement therewith. The cleaning device need not be a rotating brush disc but may comprise a stationary brush or group of brushes mounted on the frame.

DESCRIPTION OF THE DRAWINGS

A more complete appreciation of the present invention and many of the attendant advantages thereof will be readily appreciated as the same becomes better understood by reference to the following detailed description when considered in connection with the accompanying drawings in which.

DESCRIPTION OF THE PREFERRED EMBODIMENTS

Figure 1:
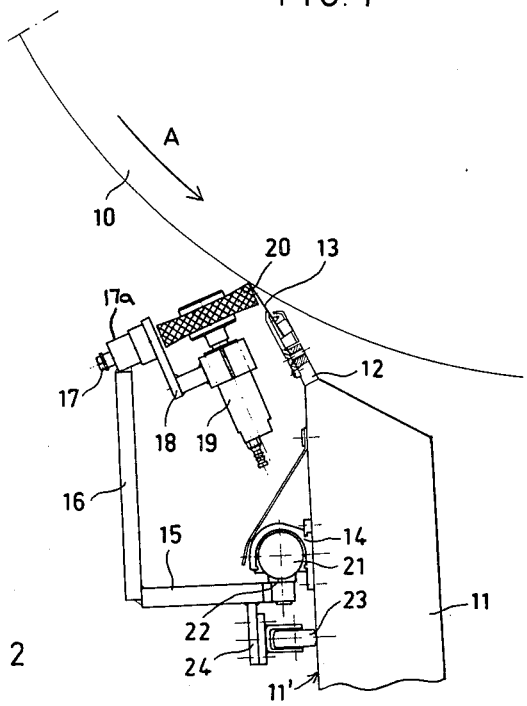
FIG. 1 is a diagrammatic side elevation view of doctor blade cleaning apparatus according to the present invention.

Referring now to the figures wherein like reference characters designate identical or corresponding parts throughout the several views, a typical roll 10 of a paper making machine is illustrated together with a doctor blade 13 which is per se conventional and which extends over substantially the entire length of roll 10 in the cross-machine direction with its upper edge engaging the surface thereof for cleaning the same as is known. Roll 10 may comprise a vapor-heated cylinder in the drying section of the paper making machine which rotates in the direction of arrow A (FIG. 1). Doctor blade 13 is removably mounted on a bracket 12 which is itself attached to the doctor blade beam 11.

The doctor blade beam 11 is typically mounted on the frame of the paper making machine in a manner such that it can be mechanically pivoted around a longitudinally extending axis such as by means of compressed air cylinders (not shown) so that the pressure exerted by the doctor blade 13 on the surface of roll 10 can be selectively adjusted to any desired extent.

Figure 2:
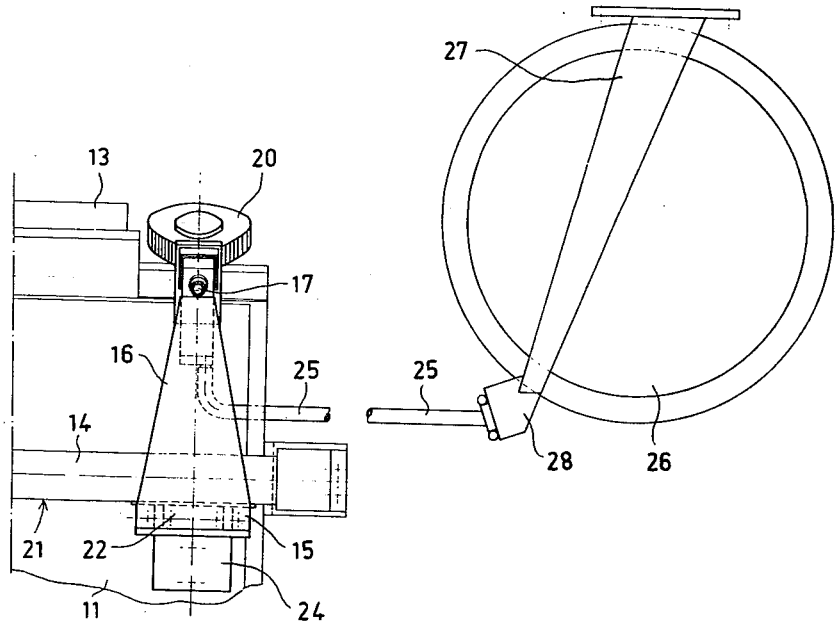
FIG. 2 is a front elevation view in schematic form of the apparatus illustrated in FIG. 1.

A power drive device in the form of a compressed air cylinder 21 is mounted to the long side surface 11' of doctor blade beam 11 and extends generally parallel to the doctor blade over substantially its entire length, and in fact extends beyond at least one edge of the doctor blade in the cross-machine direction as best seen in FIG. 2. Compressed air cylinder 21 functions as a means for driving the cleaning element along the length of the doctor blade, preferably in an oscillatory manner, to clean the same. The compressed air cylinder 21 comprising the power device preferably does not include a piston rod but only has a piston member disposed therewithin which can be made to travel axially within the cylinder by appropriate valve arrangements (not shown) which are well known in the art. The air cylinder 21 is attached to the side surface 11' of the doctor blade beam 11 by means of a bracket 14. The compressed air cylinder has an axially extending slot formed in the cylinder lining which extends over the entire length of the cylinder. A lug 22 passes from outside of the cylinder through the slot formed therein and has its inner end attached to the cylinder piston for movement therewith. The slot is sealed with thin steel tape which covers the inner side of the slot to maintain the cylinder interior in a fluid sealed configuration. As mentioned above, the cylinder is not provided with a piston rod due to its relatively small overall dimensions.

Frame means are provided which interconnect lug 22 attached to the cylinder piston to the cleaning element of the present invention. In the preferred embodiment, the frame means comprises a horizontally extending beam 15, one end of which is affixed to lug 22, and a vertically extending beam 16 whose lower end is affixed to the outer end of horizontal beam 15 and whose upper end is attached to an angle member 18 via a link 17. The angle member 18 carries a compressed air motor 19 which operates a disc-shaped brush which is attached to the output shaft of the motor 19 for rotation therewith. As best seen in FIG. 1, the brush disc 20 is so located as to engage the cleaning edge of the doctor blade 13 as it rotates.

A bracket 24 extends downwardly from the horizontal beam 15 of the frame means, bracket 24 carrying the roller 23 rotatably mounted about a vertical axis. The roller 23 bears against the planar side 11' of the doctor blade beam 11 in order to provide structural support for the brush carrying frame means as the latter oscillates in the cross-machine direction.

As seen in FIG. 2, the air motor 19 is supplied with compressed air through an air hose 25 which is adapted to be self-wound on a storage roller 26 the latter being rotatably mounted on the frame 27 of the paper making machine by means of bearings. Thus, as the brush carrying frame means oscillates under the action of the compressed air cylinder 21, the air hose 25 unwinds from the storage roller 26 and passes through a guide 28 which is attached to the end of the machine frame 27. The roller 26 is elastically suspended in a conventional manner so that hose 25 remains taut as the cleaning device oscillates over the length of the doctor blade 13.

In operation, the oscillatory movement of the brush carrying frame means is effected by suitable actuation of air cylinder 21, the latter having no piston rod as discussed above. The movement of the piston within the air cylinder is controlled by suitable control equipment which is conventional. During the oscillatory movement, the disc-shaped brush 20 is rotated by air motor 19 and traverses over the entire length of doctor blade 13 at the desired speed at preselected times.

A slewing cylinder **17*a* interconnects the upper end of vertical beam 16 of the frame means and the angle member 18 which carries the compressed air motor 19. By means of this slewing cylinder 17*a*, the orientation of the disc-shaped brush 20 can be changed. For example, the brush may traverse over the length of the doctor blade 13 while in the position illustrated in the figures but return to the original position in an orientation wherein the axis of disc-shaped brush 20** is rotated counterclockwise from the illustrated position by about 90°. In this manner, the cleaning operation is rendered more efficient.

When the cleaning apparatus is not in use, the disc-shaped brush 20 is located to the side of the doctor blade 13 as best seen in FIG. 2 so as to be out of contact therewith. During such intervals, the air hose 25 is stored on drum 26.

Of course, numerous modifications and variations of the present invention are possible in the light of the above teachings. For example, in lieu of the disc-shaped brush 20 which is rotated by air motor 19, it is possible to use a stationary brush or group of brushes which oscillates over the length of doctor blade 13. Of course, other cleaning elements than brushes may also be utilized and, further, the power drive means for oscillating the brush carrying frame can constitute pneumatic, hydraulic or other conventional apparatus. Thus, rotatable screw elements, rope devices or the like may be utilized to drive the brush carrying frame means in the oscillatory manner described above. Further, when rotating cleaning equipment is utilized, it is also possible to rotate the cleaning element by means of friction between the cleaning element disc and the doctor blade 13 or even roll 10. In such cases, when the direction of travel of the cleaning element changes, the rotating direction of the disc is similarly changed.

The apparatus of the present invention is easily automated for carryng out a blade cleaning operation, for example, every one half to one hour. Alternatively, the system can be operated manually. It is therefore to be understood that within the scope of the appended claims, the invention may be practiced otherwise than as specifically disclosed herein.

What is claimed is:

1. In a paper making machine, apparatus for cleaning a doctor blade which extends across a roll thereof in the cross-machine direction in operative cleaning relationship therewith, comprising:

frame means mounted in the area of said doctor blade for oscillating movement with respect thereto in a manner such that said frame means can traverse over substantially the entire length of said doctor blade in the cross-machine direction;

drive means coupled to said frame means for causing the latter to oscillate in the cross-machine direction; and means for cleaning the doctor blade carried by said frame means, said doctor blade cleaning means being adapted to come into cleaning contact with said doctor blade upon said frame means being caused to oscillate through the actuation of said drive means, said cleaning means comprising a rotatable, disc-shaped brush movably mounted with respect to said frame means; and motor means attached to said frame means for rotating said brush with respect to said frame means as the latter undergoes oscillating movement, whereby impurities deposited on said doctor blade can be removed therefrom during operation of said paper making machine.

2. The combination of claim 1 further including means operatively associated with said motor means for reversing the movement thereof so that the direction of movement of said cleaning means can be reversed in order to improve the cleaning action thereof.

3. The combination of claim 1 wherein said motor means comprises a compressed air motor.

4. The combination of claim 3 wherein a hose is coupled to said compressed air motor for directing compressed air to said motor, and further including a hose storage drum affixed to said paper machine by bearing members.

5. The combination of claim 1 wherein said osciallating drive means comprises a compressed air cylinder which extends over substantially the entire length of said doctor blade, said cylinder having a piston movably disposed therewithin, said frame means being attached to said piston.

6. The combination of claim 5 wherein said compressed air cylinder does not utilize a piston rod.

7. The combination of claim 5 wherein said doctor blade is mounted on a stationary doctor blade beam which extends over the substantial length of said doctor blade and further including a roller coupled to said frame means, said roller adapted to be in rolling engagement with a side surface of said doctor blade beam to assist in the support of said frame means.

* * * * *